US009797168B1

(12) United States Patent
Li

(10) Patent No.: US 9,797,168 B1
(45) Date of Patent: Oct. 24, 2017

(54) TETHERING DEVICE

(71) Applicant: Look Good Naked Training Grounds Limited, Tin Hau (HK)

(72) Inventor: Adrian Li, Tin Hau (HK)

(73) Assignee: LOOK GOOD NAKED TRAINING GROUNDS LIMITED, Tin Hau (HK)

( * ) Notice: Subject to any disclaimer, the term of this patent is extended or adjusted under 35 U.S.C. 154(b) by 0 days.

(21) Appl. No.: 15/252,473

(22) Filed: Aug. 31, 2016

(30) Foreign Application Priority Data

Apr. 16, 2016 (HK) ..... 16104394

(51) Int. Cl.
*A63C 11/00* (2006.01)
*E05B 73/00* (2006.01)
*A63C 10/28* (2012.01)

(52) U.S. Cl.
CPC ..... *E05B 73/0011* (2013.01); *A63C 10/28* (2013.01)

(58) Field of Classification Search
CPC ..... E05B 73/0011; A63C 10/28; A63C 11/00; A63C 11/004; A63C 9/002
See application file for complete search history.

(56) References Cited

U.S. PATENT DOCUMENTS 4,685,697 A 8/1987 Thorley
5,857,682 A * 1/1999 Hyman ..... A63C 5/03 280/14.21
5,960,652 A * 10/1999 Marmstad ..... E05B 73/0011 70/233
6,230,526 B1 * 5/2001 Fontes ..... A63C 11/004 280/809
6,422,048 B1 * 7/2002 Fontes ..... A63C 11/004 280/11.14
6,457,746 B1 10/2002 Schepers
7,222,883 B1 5/2007 Furlani
7,559,579 B2 7/2009 Furlani
7,806,441 B2 * 10/2010 Motto ..... A63C 11/10 280/809
8,979,113 B1 * 3/2015 Rossi ..... A63C 9/002 280/14.21
2002/0130508 A1 9/2002 Schepers
2010/0156068 A1 6/2010 Feigle et al.
2010/0327571 A1 * 12/2010 Feigle, III ..... A63C 5/06 280/809

FOREIGN PATENT DOCUMENTS

CN 2148137 Y 12/1993

OTHER PUBLICATIONS

Machine translation of CN 2148137 Y.

* cited by examiner

*Primary Examiner* — Brian L Swenson

(57) ABSTRACT

The present invention relates to a tethering device for snowboard, comprising: a housing; a tether adapted to be accommodated in the housing, the tether having a first end connected to the housing, and a second end extendable away from the housing; an engaging means arranged at the second end of the tether, the engaging means having a receiving portion receivable at a guide portion of the housing; wherein the receiving portion is profiled to conform with the guide portion such that, the receiving portion, when arranged to be received at the guide portion, is positioned in a predefined orientation.

17 Claims, 10 Drawing Sheets

TETHERING DEVICE

FIELD OF THE INVENTION

The invention relates to a device for tethering an object, particularly but not exclusively, to a device for tethering boardsports equipment.

BACKGROUND OF THE INVENTION

Snowboarding has become an increasingly popular recreational activity and winter sport. When snowboarding, the rider will generally attach his or her feet to binding mechanisms which are affixed to the upper surface of the snowboard. The rider will then descend a slope of snow while standing on the snowboard with their feet attached thereto.

At winter sports facilities or ski sites, chairlifts are commonly provided for transporting the skiers or snowboarders to a high elevation or up a hill for skiing or snowboarding. When getting on and off the chairlift and also during the ride on the chairlift, the rider will usually be required to remove one of their legs/boots from the binding. Whilst on the chairlift, the rider may either use the released leg to support the free end of the snowboard, or may simply allow the snowboard to hang whilst supported by the other leg secured to the snowboard. In both situations, the weight of the snowboard may cause discomfort and fatigue to the supporting leg, or may even cause injuries to the supporting leg in the long term.

OBJECTS OF THE INVENTION

It is an object of the present invention to overcome or ameliorate at least one of the disadvantages of the prior art, or to provide a useful alternative.

The above object is met by the combination of features of the main claim; the sub-claims disclose further advantageous embodiments of the invention.

One skilled in the art will derive from the following description other objects of the invention. Therefore, the foregoing statement of object is not exhaustive and serves merely to illustrate one of the many objects of the present invention.

SUMMARY OF THE INVENTION

In one main aspect, the invention provides a device for tethering a board sport equipment such as a snowboard. The device comprises a housing; a tether adapted to be accommodated in the housing, the tether having a first end connected to the housing, and a second end extendable away from the housing; an engaging means arranged at the second end of the tether, the engaging means having a receiving portion receivable at a guide portion of the housing; wherein the receiving portion is profiled to conform with the guide portion such that, the receiving portion, when arranged to be received at the guide portion, is positioned in a predefined orientation.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figures, of which.

DETAILED DESCRIPTION OF THE PREFERRED EMBODIMENTS

The following is a description of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

Figure 1:
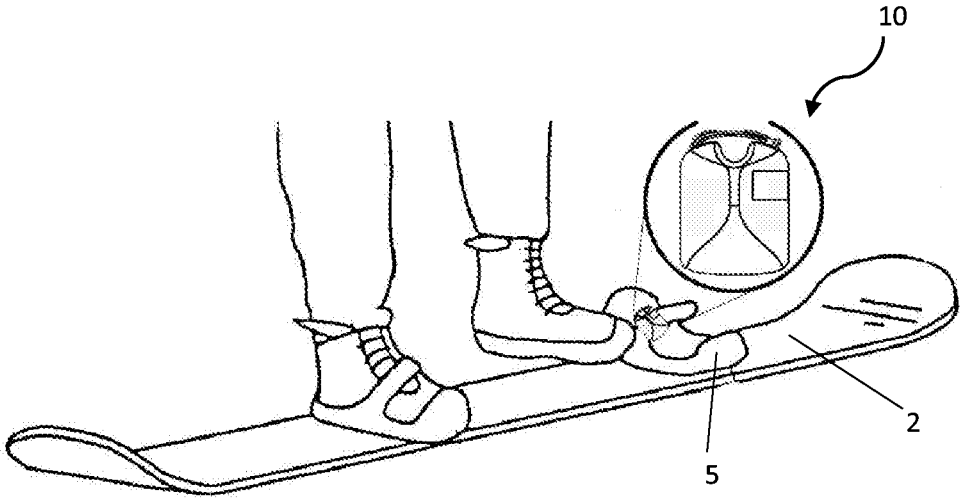
FIG. 1 is a perspective view showing an embodiment of the tethering device according to the present invention when attached to a binding mechanism of a snowboard.

The present invention relates to a device for tethering boardsports equipment such as, but not limited to, a snowboard or a snowboard binding mechanism. Referring to FIG. 1, there is shown an exemplified application of a tethering device 10 according to the present invention. In use, the device 10 is attached to either one of the binding mechanisms affixed at an upper surface of a snowboard 2. The binding mechanisms are generally designed to provide a secure fastening of a rider's boots to the snowboard 2. As shown in the figure, the device 10 is attached to a strap of a snowboard binding 5, which is adapted to release from the rider's boot so as to disengage the rider's leg from the snowboard 2 when the rider is getting on or off a chairlift and during the chairlift ride. Alternatively, the device 10 may be attached to a strap of the other snowboard binding which will be continuously engaged with the rider's boot when in use. Although the devices as embodied herein are mainly for use in tethering snowboards, it is appreciated that the device of the present invention should also be applicable for tethering or securing other types of board or board-like equipment for sports or recreational purposes. For example, the device of the present invention is also applicable for tethering, connecting, harnessing or securing other boards in boardsports such as skateboards, sleds, surfboards, or skis etc., as long as the applications are considered suitable and appropriate without departing from the spirit of the present invention.

Figure 2:
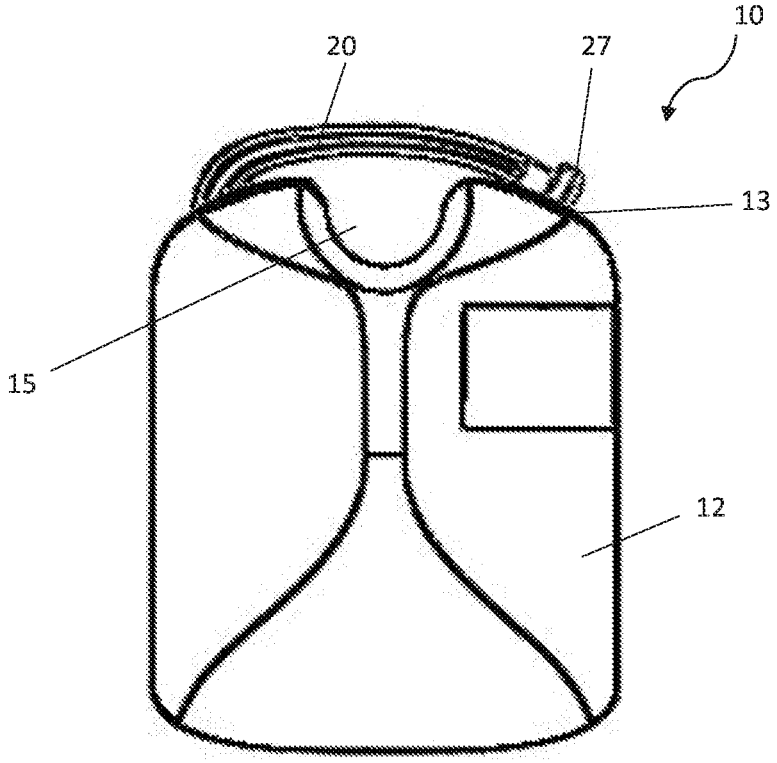
FIG. 2 is a front view showing the embodiment of FIG. 1.
Figure 3:
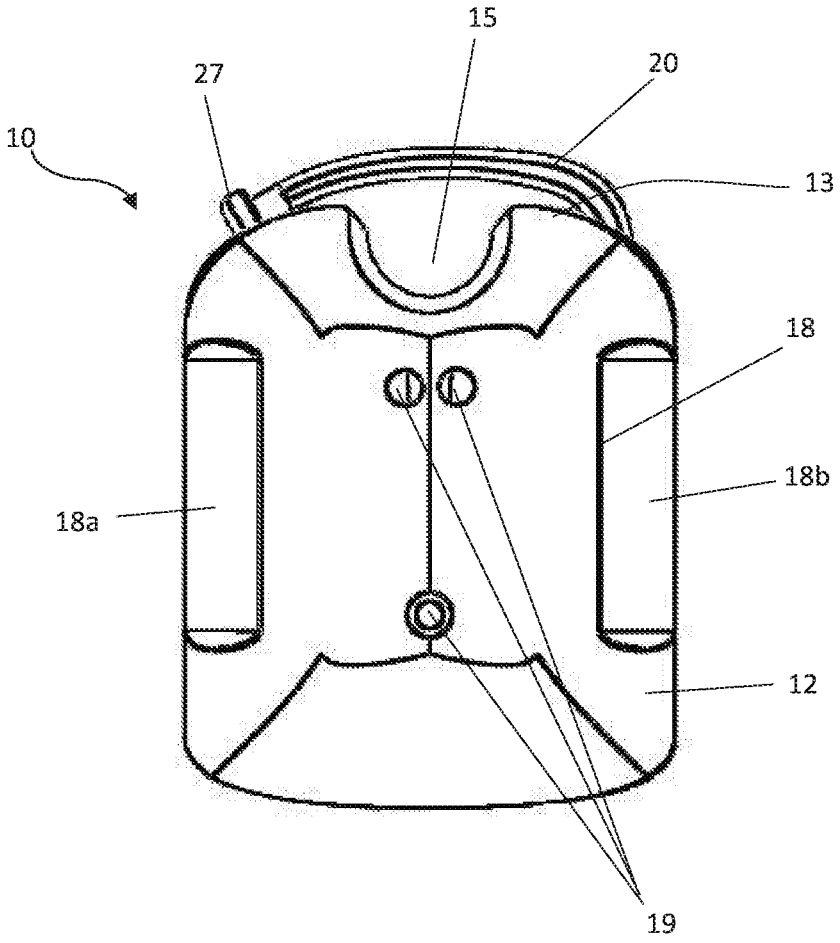
FIG. 3 is a rear view showing the embodiment of FIG. 1.

Corresponding front and rear views of an embodiment of the present invention are illustrated in FIGS. 2 and 3, respectively. In this embodiment, the device 10 comprises a housing 12 and a tether 30 adapted to be accommodated within the housing 12. When the tether 30 of the device 10 is not in use, it can be stored within the housing 12 (as shown in these figures) so that it does not interfere with any movements of the user.

Figure 7:
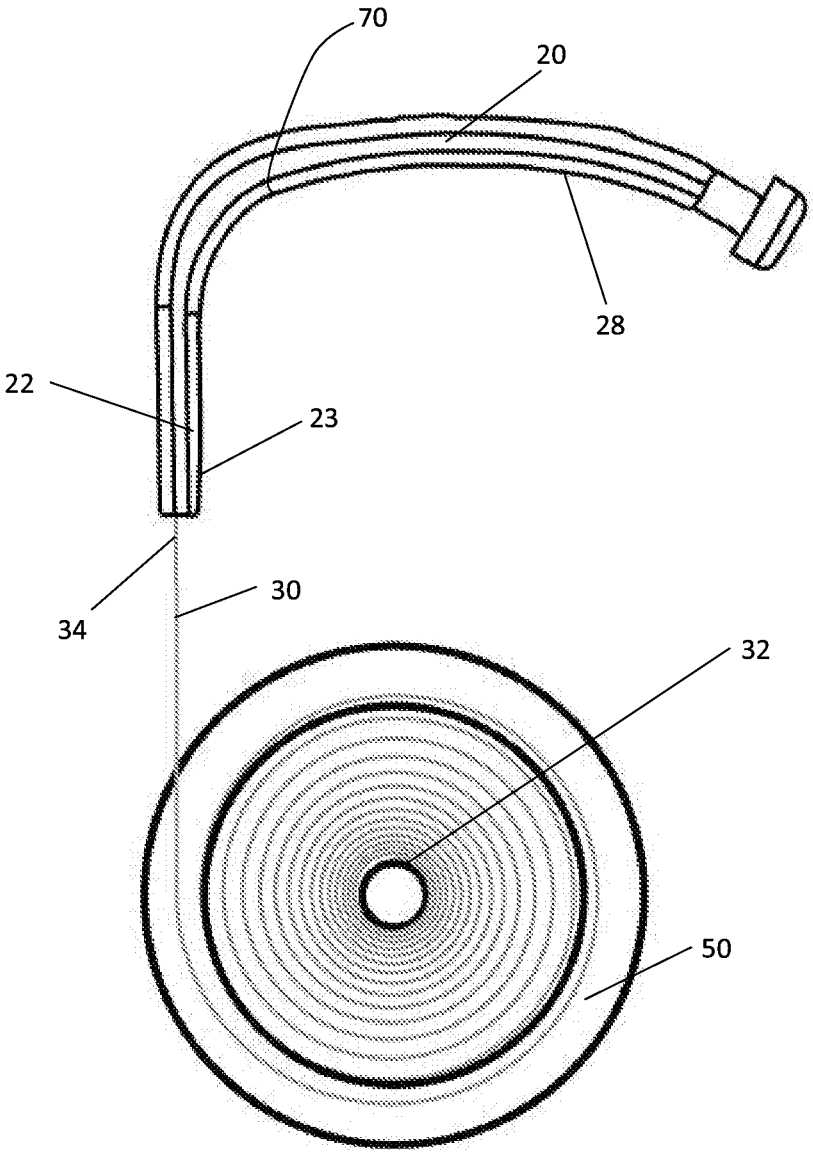
FIG. 7 showing a reel, a tether and the engaging means of the embodiment of FIG. 1.

Specifically, the tether 30 comprises a first end 32 connected to the housing 12, and a second end 34 extendable away from the housing 12 (see, for example, FIG. 7). The tether 30 can be formed of any type of generally long and flexible wires, threads, strings, cables or the like applicable for the purposes of the present invention. For example, the tether 30 can be made of any strong, flexible and relatively lightweight materials with good resistance to low temperature, as long as they are considered suitable and applicable by a person skilled in this technical field. In one embodiment, the tether 30 can be made of materials such as, but are not limited to, synthetic polymers such as nylon.

Figure 4:
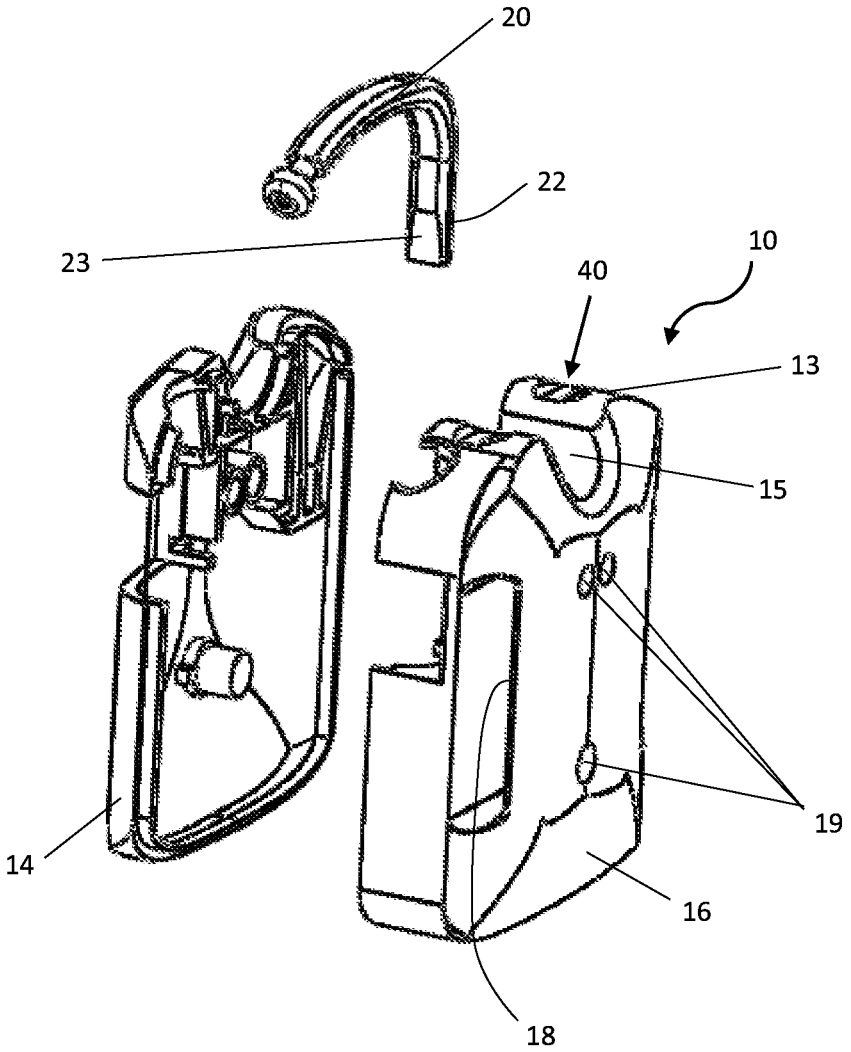
FIG. 4 is an exploded view showing part of the embodiment of FIG. 1.

An exploded view of the housing 12 is shown in FIG. 4 which reveals that the housing 12 can be assembled from a front casing 14 and a rear casing 16. Although, a person skilled in the art would appreciate that any other modes of assembly or configurations of the housing 12 are also encompassed by the present invention as long as they are considered appropriate. For example, the front and the rear casings 14, 16 can be manufactured from injection molding, in part or in whole, of acrylonitrile butadiene styrene (ABS).

As best shown in FIGS. 3 and 4, the housing 12 may comprise a connecting means 18 adapted to connect the device 10 to the snowboard or the snowboard binding mechanism 5. For example, the connecting means 18 may include at least one slot or channel which traverses the housing 12 for receiving and/or engaging at least one strap of the snowboard binding mechanism 5. In this particular embodiment, a slot 18 is provided at the rear casing 16 of the housing 12, with openings 18*a* and 18*b* arranged at the opposite sides of the housing 12 to allow at least one strap of the binding mechanism 5 to pass therethrough. The strap may further be fastened at the housing 12 via a plurality of fastening means 19 such as screw connections. The preferred arrangement of the connecting means 18 which comprises a slot 18 and three apertures for accommodating the corresponding screw connections 19 at the rear casing 16 are shown in FIGS. 3 and 4. It will be apparent to those skilled in the art that the connection means 18 may comprise alternative arrangements such as variable numbers of screw connections 19 and/or different forms of connections.

The device 10 also comprises an engaging means 20 arranged at the second end 34 of the tether 30. Specifically, the engaging means 20 includes a receiving portion 22 receivable at a guide portion 40 of the housing 12. The receiving portion 22 is profiled to conform with the guide portion 40 such that the receiving portion 22, when received at the guide portion 40, is positioned in a predefined orientation.

In one preferred embodiment, the predefined orientation can be a specific positioning of the receiving portion 22 relative to the housing 12 which allows the engaging means 20, when coupled to the housing 12, to conform substantially with a shape of an adjacent portion of the housing 12 and/or the overall shape of the housing 12. Examples of this conformation are shown in FIGS. 2 and 3. The term "conform" in the context of this specification includes, for example, when the receiving portion 22 is received at the guide portion 40, the contour of the engaging means 20 is in a similar form to or substantially align with the overall shape of the housing 12. This is advantageous in that, when the device 10 is attached to the binding mechanism 5, any movements of the user will not be interfered with by the presence of the device 10. In another embodiment, the predefined orientation can be a specific positioning of the receiving portion 22 relative to the housing 12 which allows at least part of the engaging means 20 to be snugly received at the housing 12. For example, the housing 12 can be arranged with one or more recesses at one or more corresponding outer surfaces which are adapted to receive at least part of the engaging means 20. This is advantageous in that it allows an even more compact and streamlined structure for the device 10 when the engaging means 20 is coupled to the housing 12.

In yet a further embodiment, the predefined orientation can be a specific positioning of the receiving portion 22 relative to the housing 12 which allows the engaging means 20 to be substantially flush with an outer wall of the housing 12, so that a substantially uniform shape and neat configuration of the device 10 can be achieved.

Figure 5:
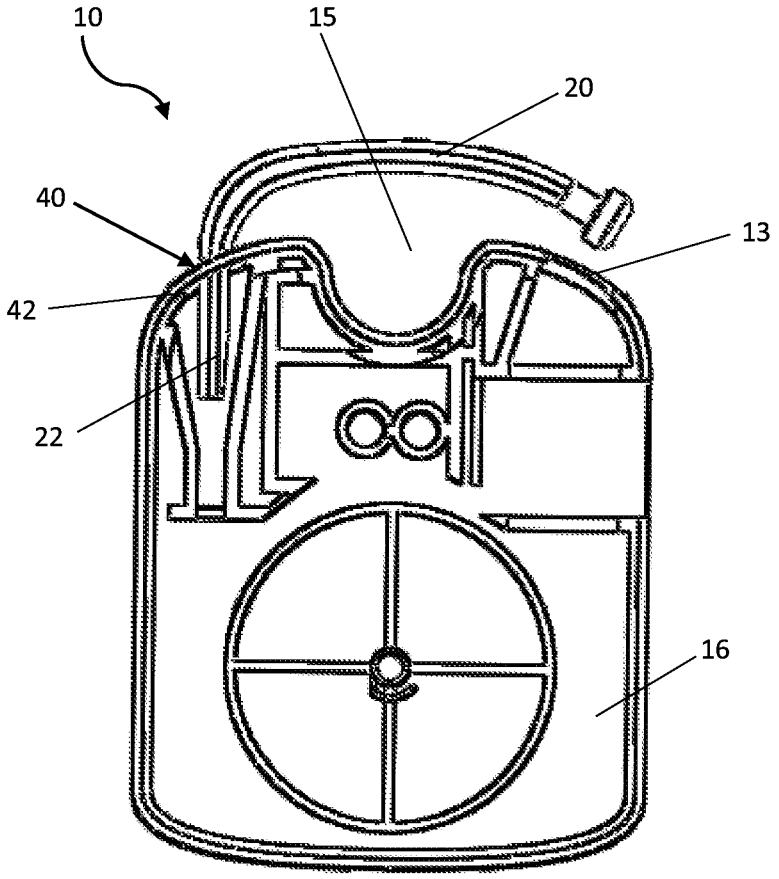
FIG. 5 is a cross-sectional view showing a housing and an engaging means of the embodiment of FIG. 1.

In the embodiment as shown in FIGS. 4 and 5, the guide portion 40 can be provided at one side 13 of the housing 12. The guide portion 40 can include an opening 42 through which at least part of the receiving portion 22 can be inserted into the housing 12. The guide portion 40 can be integrally formed with the housing 12, or as a separate part installable at the housing 12. Specifically, the opening 42 of the guide portion 40 is profiled to conform to the receiving portion 22 such that the opening 42 is adapted to receive the receiving portion 22 only when the receiving portion 22 is arranged at the predefined orientation. For example, the opening 42 can be configured to define a passageway with a substantially trapezoidal cross-section, so that a part of the receiving portion 22 having a corresponding trapezoidal cross-section can only be received therein when it is arranged in the matching orientation and thus to prevent any relative rotating movement between the receiving portion 22 and the guide portion 40. In another embodiment, the receiving portion 22 can also be configured with at least one inclined face 23 which assists in coordinating the insertion of the receiving portion 22 into a tapered guide portion 40 with matching configuration when arranged in the predefined orientation. For example, the inclined face 23 can be configured to conform with a corresponding tapered surface of the guide portion 40, such that the receiving portion 22 is only receivable into the guide portion 40 when the inclined face 23 is aligned with and optionally abut the corresponding tapered surface of the guide portion 40 when arranged in the predefined orientation.

It would be appreciated that the present invention should not be limited to be above described embodiments of the guide portion and/or the receiving portion in their specific configurations. Instead, any constructions or configurations of the guide portion and/or the corresponding receiving portion of the engaging means should also be encompassed, as long as the opening of the guide portion is profiled in a way to conform to the receiving portion such that the opening is adapted to receive the receiving portion only when the receiving portion is arranged at the predefined orientation.

The profiled receiving portion 22 and its matching association with the corresponding guide portion 40 allow the engaging means 20 to automatically align its orientation with the guide portion 40 when the tether 30 is retracted and that the receiving portion 22 is received into the housing 12 so as to provide a compact and streamlined overall structure of the device 10. This auto-aligning and self-coupling of the engaging means 20 with the housing 12 is convenient in a way that it negates the need for the user to look at the orientation of the engaging means 20 and to manually align the coupling of the engaging means 20 with the housing 12 during the tether retraction. Furthermore, the auto-alignment is important as any misalignment between the engaging means 20 and the housing 12 may result in the engaging means 20 as protruding from the overall structure of the housing 12, for example, at an angle pointing away from the housing 12, which may interfere with the snowboarding or other movement of the user.

Figure 6:
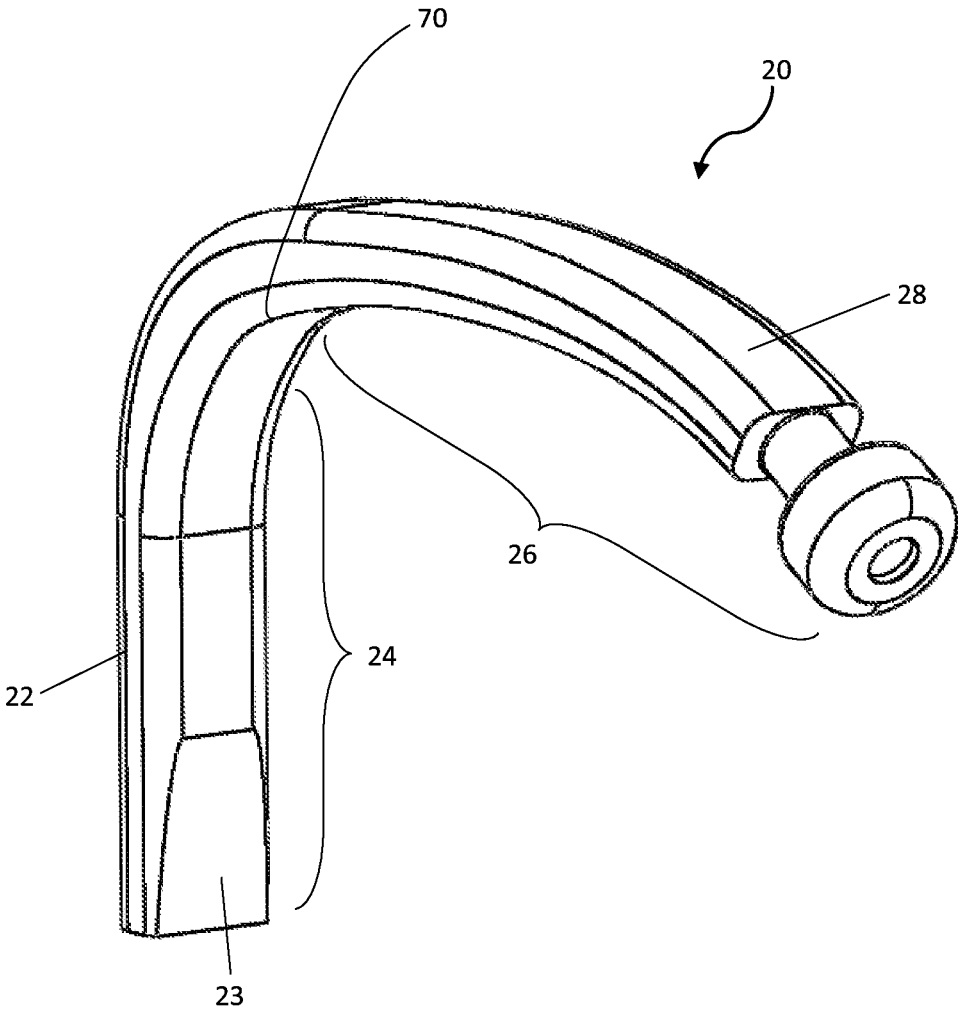
FIG. 6 is perspective view showing the engaging means of the embodiment of FIG. 1.
Figure 9:
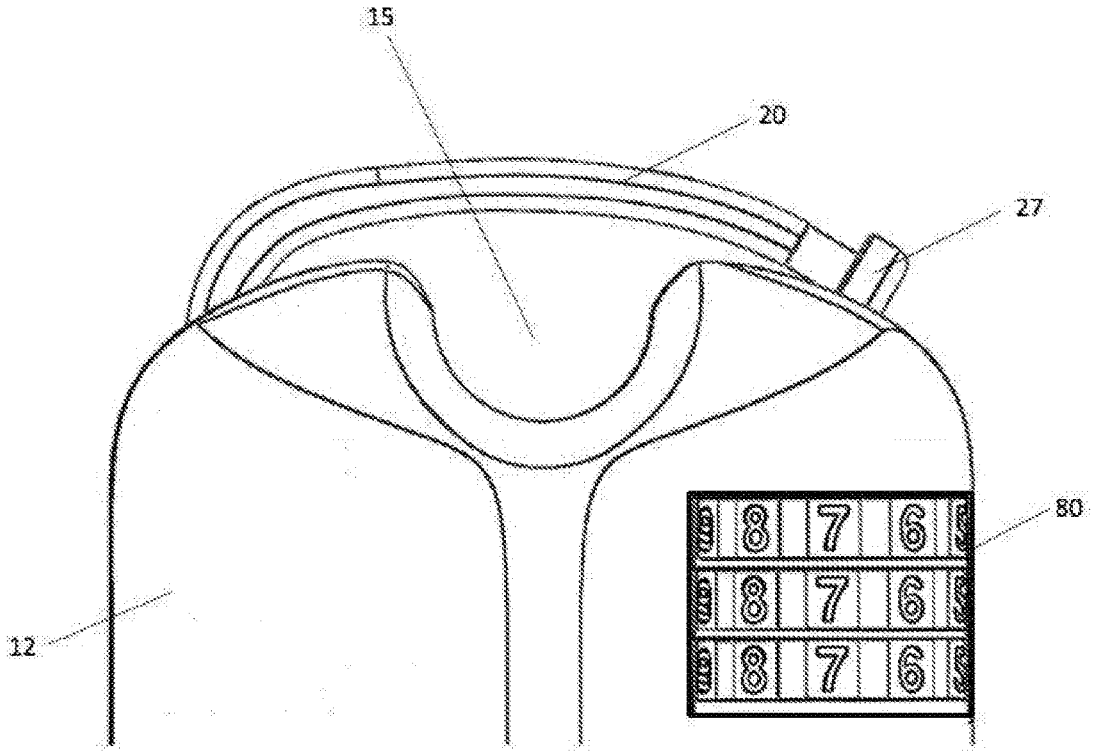
FIG. 9 is a front, partial view showing another embodiment of the device according to the present invention.
Figure 10:
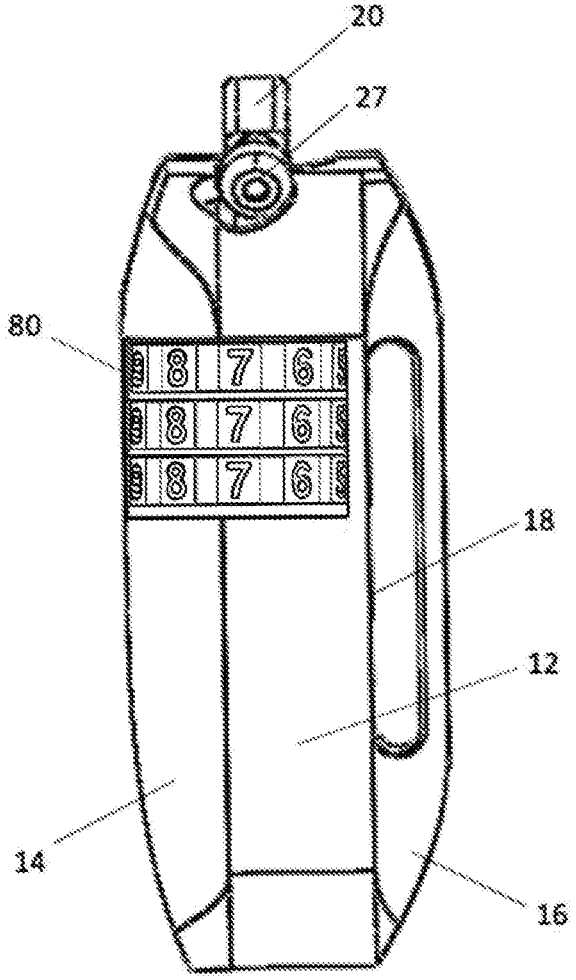
FIG. 10 is a side view showing the embodiment of FIG. 9.

An enlarged view of the engaging means 20 is shown in FIG. 6. In this embodiment, the engaging means 20 comprises a first arm 24 and a second arm 26 arranged at an angle to each other, with the first arm 24 having the receiving portion 22 and the second arm 26 having one or more functional portions. For example, the second arm 26 may comprise a handle portion 28 adapted to be manipulated by a user, such as to allow the user to easily grip the handle portion 28 and pull the tether 30 out from the housing 12, and/or to allow the user to securely hold the tether 30 to support the weight of the snowboard 2. The second arm 26 can also comprise an engaging portion 70 adapted to releasably engage with an anchor. For example, the engaging portion 70 can comprise a hook attachable to a railing or a safety bar of a chairlift to thereby connect the device 10 (and thus the snowboard 2) to the chairlift. The engaging portion 70 may preferably comprise a head portion 27 at an end distal to the receiving portion 22. For example, the head portion 27 can be configured in the form of a bulged, round-headed end of the second arm 26. The head portion 27 may work cooperatively with a lock member 80 (as shown in FIGS. 9 and 10) at the housing 12 to facilitate locking of the engaging means 20 with the lock member 80 and/or the housing 12.

The connection between the chairlift and the snowboard 2 via the device 10 assists in supporting the weight of the snowboard when one leg of the user is released from the binding mechanism 5. Particularly, the engaging portion 70 allows a secure attachment of the tether 30 with the chairlift to support the snowboard during the chairlift ride, and also a simple and easy detachment of the tether 30 from the chairlift when the support is no longer required.

In one embodiment, the engaging means 20 is preferred to be formed of a material of high mechanical strength such as steel.

In the embodiment as shown in FIGS. 2, 3 and 5, when the receiving portion 22 is received at the guide portion 40 and the engaging means 20 is restricted to be seated in the predefined orientation, the second arm 26 of the engaging means 20 can be arranged to substantially align with the side 13 of the housing 12. The first arm 24 can be arranged to be substantially transverse to the side 13 of the housing 12, which is best shown in FIG. 5. In yet a further embodiment, the second arm 26 can even be at least partially received within a recess in the side 13 of the housing 12 when the receiving portion 22 is received at the guide portion 40 to enable a more compact and streamlined structure for the device 10 when the engaging means 20 is coupled with the housing 12.

The housing 12 may optionally comprise one or more depressions 15 at, for example, the side 13 of the housing 12 to allow easy access to the engaging means by the user so that the user can easily grip the engaging means 20 and pull and extend the tether 30 away from the housing 12. Alternatively or additionally, the engaging means 20 can also be configured with one or more depressions facing the housing 12 to further assist the easy gripping of the engaging means 20 from the housing 12 by the user.

Figure 8:
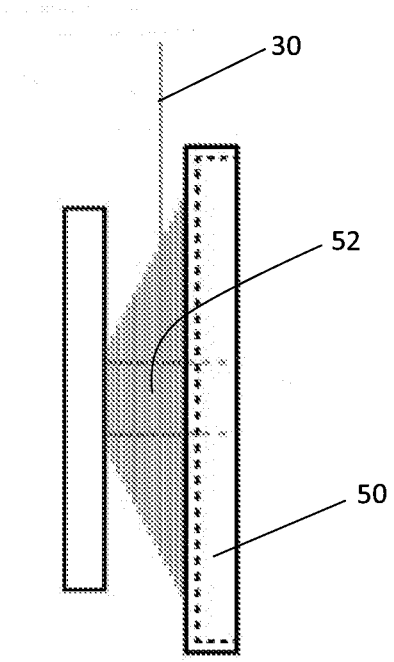
FIG. 8 is a side view of the reel of FIG. 7.

FIGS. 7 and 8 illustrate a reel 50 about which the tether 30 is wound when it is accommodated and stored within the housing 12. Specifically, FIG. 7 shows the first end 32 and the second end 34 which are arranged to connect to the reel 50 and the engaging means 20, respectively. In one embodiment, the first end 32 of the tether 30 can be arranged to connect to the reel 50 of the housing 12 via a retractable mechanism 52 such that the tether 30, when extended, can be retracted and/or recoiled into the housing 12. In use during a chairlift ride, the user may grab the handle portion 28 of the engaging means 20 and then pull, draw or drag the tether 30 away from the housing 12. The user may then arrange the engaging portion 70 to hook and/or attach onto a railing or a safety bar of the chairlift to securely connect the device 10 to the chairlift. At the end of the ride, the user can easily detach the engaging portion 70 from the railing or safety bar to release the engaging means 20 from the chairlift. For example, the user can simply push off or slide off the engaging portion 70 from the railing when he/she is ready to get off the chairlift.

Under the action of the retractable mechanism 52, the released tether 30 will be automatically retracted and rewound into the housing 12, with the profiled receiving portion 22 of the engaging means 20 self-aligning whilst being received, thereby allowing the coupling of the engaging means 20 automatically at the housing 12 in the predefined orientation. Particularly, the receiving portion 22 is adapted to automatically align itself with the guide portion 40 so that the user does not have to look at, guide or position the direction of the engaging means 20 relative to the guide portion 40 when the tether 30 is retracted into the housing 12 and the receiving portion 22 is received into the housing 12.

It is appreciated that the retractable mechanism 52 may comprise any means in any known configurations as long as it is capable of retracting the tether 30 into the housing 12. For example, the retractable mechanism 52 may comprise a resilient means such as a spring coil for automatically retracting, rewinding and/or recoiling the extended tether 30 into the housing 12. Alternatively, a switch member can also be provided at the housing 12 to actuate retraction of the tether 30 by the user. In one embodiment, the retractable mechanism 52 may function cooperatively with a ratchet mechanism to allow adjustment of the degree of extension and/or retraction of the tether 30. The extension of the tether 30 can further be controlled by a clutch member, which allows adjustment and/or control of the extension of the tether 30 to a predetermined length.

In a further embodiment as shown in FIGS. 9 and 10, the device 10 may further comprise a lock member 80 at the housing 12 adapted to lock the engaging means 20 with the lock member 80 and/or the housing 12. Particularly, when the engaging means 20 is pulled by the user to extend the tether 30 from the housing 12, the engaging means 20 can be arranged in an orientation such that the head portion 27 is insertable into a corresponding opening of the lock member 80 to thereby locking the engaging means 20 at the housing 12 and/or the lock member 80. Although a combination lock is illustrated in the figures, the lock member 80 may include any type of locking means such as mechanical key locks or electronic locks. As the device 10 is attached to the snowboard 2 and/or the snowboard binding 5, when the snowboard 2 is not in use, the user can pull out the engaging means 20 from the housing 12 to extend the tether 30, and subsequently, arrange the extended tether 30 to wrap around a stationary, fixed object. The engaging means 20 can then be positioned such that the head portion 27 can be inserted into the corresponding opening of the lock member 80. The head portion 27 will then engage the locking mechanism of the lock member 80 to lock the engaging means 20 with the lock member 80 and/or the housing 12. This allows the device 10 to serve as a lock to secure the snowboard 2 with the fixed object to prevent theft.

The device 10 of the present invention is adapted to be attached to the snowboard 2 or the binding mechanism 5 of the snowboard 2, and is preferred to be permanently affixed thereto. When the snowboarder is on the chairlift, he/she can simply reach down to the snowboard 2 to grab the retractable engaging means 20 from the device 10. The hook of the engaging means 20 can then be arranged to be securely attached to a railing or safety bar of the chairlift. This arrangement allows the railing or the safety bar to take most of the weight of the snowboard 2 during the chairlift ride and thus reduce the stress imposed on the leg of the snowboarder. In addition, the receiving portion 22 of the engaging means 20 is profiled such that, when the engaging means 20 is allowed to retract back into the housing 12, the engaging means 20 is adapted to automatically align its orientation with the guide portion 40 as it is received into the housing 12. The engaging means 20 is also configured such that, when coupled with the housing 12, it conforms with the overall shape of the housing 12 to form a compact and streamlined structure so that the device 10 when attached with the snowboard 2 or the binding mechanism 5, will not interfere with the user to cause any inconvenience, injury, or other potential dangers during snowboarding. Furthermore, the retractable tether 30 and the auto-aligning and self-coupling functionality of the engaging means 20 with the housing 12 is convenient and easy to use, negating the need for the user to manually adjust the retraction, look at the orientation of the engaging means 20, and to align the coupling of the engaging means 20 with the housing 12.

The invention claimed is:

1. A device for tethering boardsports equipment, comprising:

a housing;

a tether adapted to be accommodated in the housing, the tether having a first end connected to the housing, and a second end extendable away from the housing;

an engaging means arranged at the second end of the tether, the engaging means comprising a first arm and a second arm arranged at an angle to each other, with the first arm comprising a receiving portion receivable at a guide portion of the housing;

wherein the receiving portion is profiled to conform with the guide portion such that, when the receiving portion is received at the guide portion, the engaging means is restricted to be positioned in only one predefined orientation.

2. The device according to claim 1, wherein the engaging means is configured to conform substantially with a shape of an adjacent portion of the housing when the receiving portion is positioned in the predefined orientation.

3. The device according to claim 1, wherein the engaging means is adapted to be at least partially received at the housing when the receiving portion is positioned in the predefined orientation.

4. The device according to claim 1, wherein the engaging means is arranged to be substantially flush with an outer wall of the housing when the receiving portion is positioned in the predefined orientation.

5. The device according to claim 1, wherein the engaging means comprises a handle portion adapted to be manipulated by a user.

6. The device according to claim 1, wherein the engaging means comprises an engaging portion adapted to releasably engage with an anchor.

7. The device according to claim 6, wherein the engaging portion comprises a hook attachable to the anchor and wherein the anchor is a railing of a chairlift.

8. The device according to claim 1, wherein, when the receiving portion is received at the guide portion, the second arm of the engaging means is arranged to substantially align with a side of the housing, and the first arm of the engaging means is arranged to be substantially transverse to the side of the housing.

9. The device according to claim 8, wherein, when the receiving portion is received at the guide portion, the second arm is at least partially received within a recess in the side of the housing.

10. The device according to claim 1, wherein the first end of the tether is connected to the housing via a retractable mechanism such that the tether, when extended, is retractable into the housing.

11. The device according to claim 10, wherein the retractable mechanism comprises a resilient means for retracting the tether.

12. The device according to claim 1, wherein the housing comprises a reel about which the tether is wound when it is accommodated in the housing.

13. The device according to claim 1, further comprising a clutch adapted to control extension of the tether.

14. The device according to claim 13, wherein the clutch is adapted to control extension of the tether to a predetermined length.

15. The device according to claim 1, further comprising a lock member adapted to lock the engaging means at the housing.

16. The device according to claim 1, wherein the housing comprises a connecting means adapted to connect the device to a board or a binding mechanism on the board.

17. The device according to claim 1, wherein the device is for tethering a snowboard or a binding mechanism on the snowboard.

* * * * *